US006062415A

United States Patent [19]

Harper

[11] Patent Number: 6,062,415

[45] Date of Patent: May 16, 2000

[54] TROWEL HOLDING LID

[76] Inventor: George A. Harper, 12243 Capital Blvd., Ste. 707, Wake Forest, N.C. 27587

[21] Appl. No.: 09/054,247

[22] Filed: Apr. 2, 1998

[51] Int. Cl.[7] ..... B65D 1/24

[52] U.S. Cl. ..... 220/521; 220/212; 220/212.5; 220/759; 220/760; 220/772

[58] Field of Search ..... 220/521, 212, 220/212.5, 759, 760, 772

[56] References Cited

U.S. PATENT DOCUMENTS

| | | | |
|---|---|---|---|
| 2,101,492 | 12/1937 | Cogswell | 220/759 X |
| 2,323,436 | 7/1943 | Yakee | 220/521 |
| 2,766,796 | 10/1956 | Tupper | 220/521 |
| 3,083,886 | 4/1963 | Fry | 220/759 X |
| 3,482,419 | 12/1969 | Moore | 220/521 X |
| 4,091,953 | 5/1978 | Daenen | 220/521 X |
| 5,325,962 | 7/1994 | Ouellette | 220/521 X |
| 5,447,259 | 9/1995 | Erickson | 220/759 |
| 5,507,385 | 4/1996 | Koloski et al. | 220/521 X |

*Primary Examiner*—Stephen K. Cronin

[57] ABSTRACT

A new trowel holding lid for storing a trowel when not in use. The inventive device includes a base having upper and lower surfaces. A wall is extended from the upper surface of the base and defines an interior space. The wall has a top edge which defines an upper opening into the interior space. A cover has upper and lower faces with the lower face resting on the top edge of the wall such that the cover substantially covers the upper opening into the interior space.

1 Claim, 2 Drawing Sheets

TROWEL HOLDING LID

BACKGROUND OF THE INVENTION

1. Field of the Invention

The present invention relates to accessories for containers, in particular five gallon buckets or pails and more particularly pertains to a new trowel holding lid for storing a trowel when not in use.

2. Description of the Prior Art

The use of accessories for containers, in particular five gallon buckets or pails is known in the prior art. More specifically, accessories for containers, in particular five gallon buckets or pails heretofore devised and utilized are known to consist basically of familiar, expected and obvious structural configurations, notwithstanding the myriad of designs encompassed by the crowded prior art which have been developed for the fulfillment of countless objectives and requirements.

Known prior art accessories for containers, in particular five gallon buckets or pails include U.S. Pat. No. 4,356,916; U.S. Pat. No. 4,490,878; U.S. Pat. No. Des. 289,455; U.S. Pat. No. 4,866,805; U.S. Pat. No. 4,793,018; and U.S. Pat. No. 4,420,093.

While these devices fulfill their respective, particular objectives and requirements, the aforementioned patents do not disclose a new trowel holding lid. The inventive device includes a base having upper and lower surfaces. A wall is extended from the upper surface of the base and defines an interior space. The wall has a top edge which defines an upper opening into the interior space. A cover has upper and lower faces with the lower face resting on the top edge of the wall such that the cover substantially covers the upper opening into the interior space.

In these respects, the trowel holding lid according to the present invention substantially departs from the conventional concepts and designs of the prior art, and in so doing provides an apparatus primarily developed for the purpose of storing a trowel when not in use.

SUMMARY OF THE INVENTION

In view of the foregoing disadvantages inherent in the known types of accessories for containers, in particular five gallon buckets or pails now present in the prior art, the present invention provides a new trowel holding lid construction wherein the same can be utilized for storing a trowel when not in use.

The general purpose of the present invention, which will be described subsequently in greater detail, is to provide a new trowel holding lid apparatus and method which has many of the advantages of the accessories for containers, in particular five gallon buckets or pails mentioned heretofore and many novel features that result in a new trowel holding lid which is not anticipated, rendered obvious, suggested, or even implied by any of the prior art accessories for containers, in particular five gallon buckets or pails, either alone or in any combination thereof.

To attain this, the present invention generally comprises a base having upper and lower surfaces. A wall is extended from the upper surface of the base and defines an interior space. The wall has a top edge which defines an upper opening into the interior space. A cover has upper and lower faces with the lower face resting on the top edge of the wall such that the cover substantially covers the upper opening into the interior space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trowel holding lid apparatus and method which has many of the advantages of the accessories for containers, in particular five gallon buckets or pails mentioned heretofore and many novel features that result in a new trowel holding lid which is not anticipated, rendered obvious, suggested, or even implied by any of the prior art accessories for containers, in particular five gallon buckets or pails, either alone or in any combination thereof.

It is another object of the present invention to provide a new trowel holding lid which may be easily and efficiently manufactured and marketed.

It is a further object of the present invention to provide a new trowel holding lid which is of a durable and reliable construction.

An even further object of the present invention is to provide a new trowel holding lid which is susceptible of a low cost of manufacture with regard to both materials and labor, and which accordingly is then susceptible of low prices of sale to the consuming public, thereby making such trowel holding lid economically available to the buying public.

Still yet another object of the present invention is to provide a new trowel holding lid which provides in the apparatuses and methods of the prior art some of the advantages thereof, while simultaneously overcoming some of the disadvantages normally associated therewith.

Still another object of the present invention is to provide a new trowel holding lid for storing a trowel when not in use.

Yet another object of the present invention is to provide a new trowel holding lid which includes a base having upper and lower surfaces. A wall is extended from the upper surface of the base and defines an interior space. The wall has a top edge which defines an upper opening into the interior space. A cover has upper and lower faces with the lower face resting on the top edge of the wall such that the cover substantially covers the upper opening into the interior space.

Still yet another object of the present invention is to provide a new trowel holding lid that cleans trowels by including a cleaning solution in the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
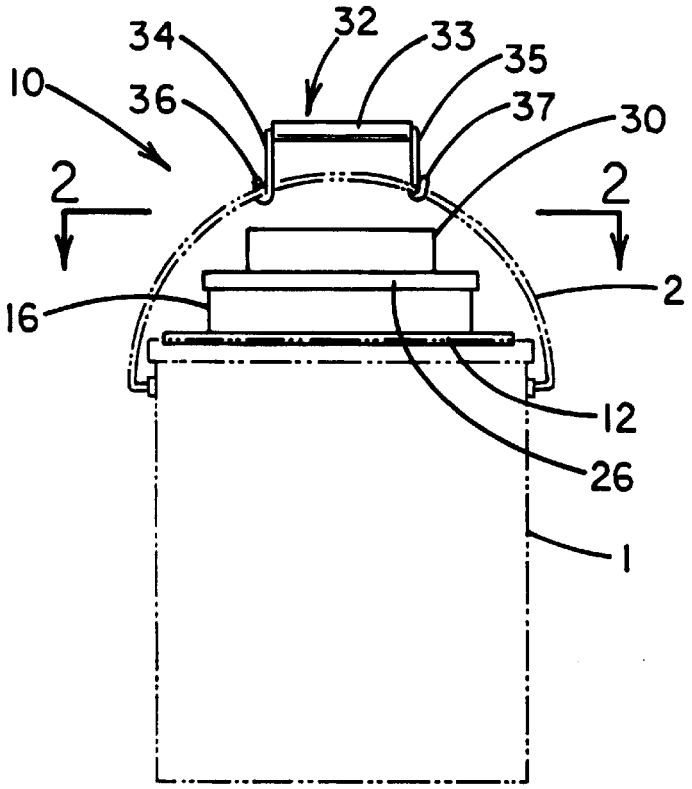
FIG. 1 is a schematic side view of a new trowel holding lid on a bucket according to the present invention.
Figure 2:
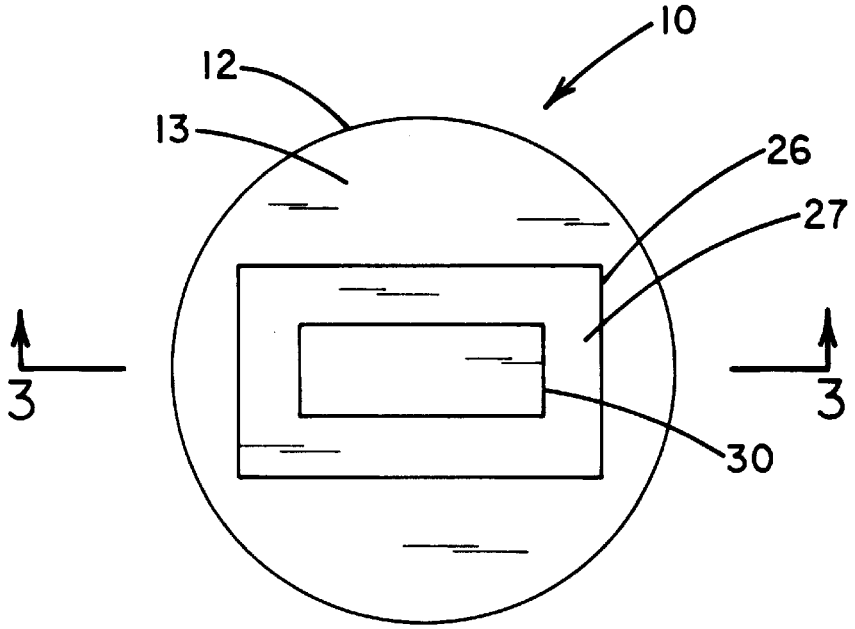
FIG. 2 is a schematic top side view of the present invention as seen from line 2—2 on FIG. 1.
Figure 3:
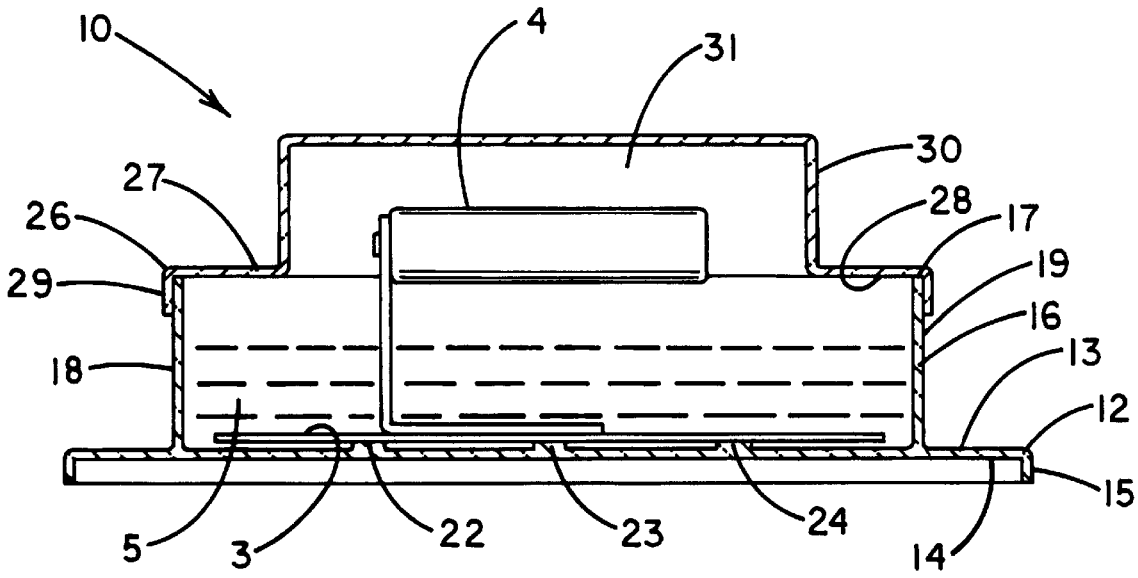
FIG. 3 is a schematic cross-sectional view of the present invention taken from line 3—3 of FIG. 2.
Figure 4:
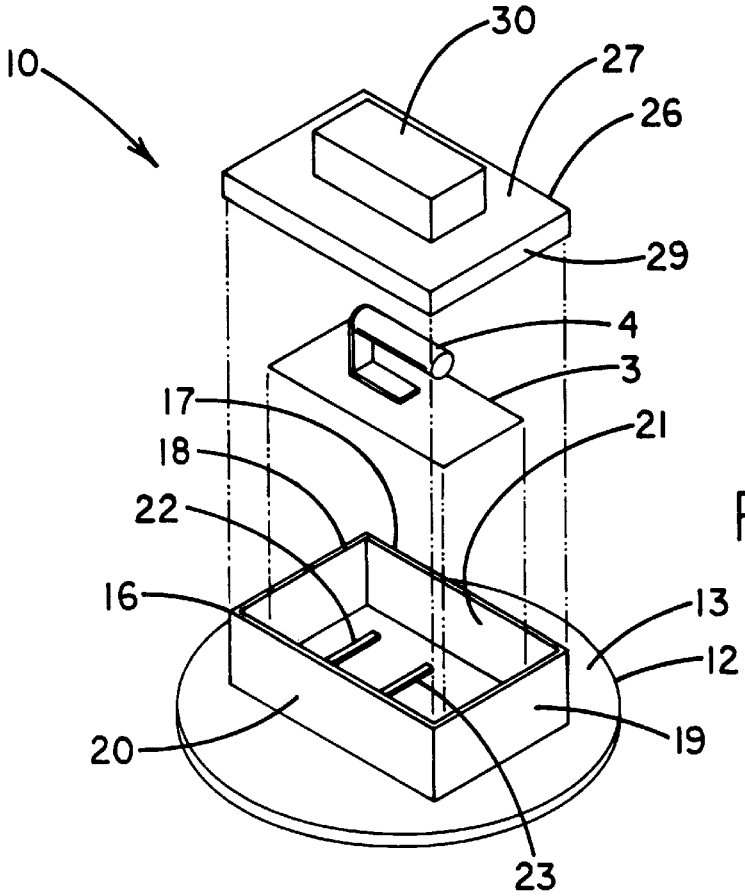
FIG. 4 is a schematic exploded perspective view of the present invention.

With reference now to the drawings, and in particular to FIGS. 1 through 4 thereof, a new trowel holding lid embodying the principles and concepts of the present invention and generally designated by the reference numeral 10 will be described.

As best illustrated in FIGS. 1 through 4, the trowel holding lid 10 generally comprises a base 12 having upper and lower surfaces 13,14. A wall 16 is extended from the upper surface 13 of the base 12 and defines an interior space. The wall 16 has a top edge 17 which defines an upper opening into the interior space. A cover 26 has upper and lower faces 27,28 with the lower face 28 resting on the top edge 17 of the wall 16 such that the cover 26 substantially covers the upper opening into the interior space.

In closer detail, the lid is designed for covering a circular top opening of a cylindrical container 1, such as a five gallon bucket. The base 12 is generally circular and has upper and lower surfaces 13,14. The lower surface 14 of the base 12 is designed for resting on an upper edge of a container 1 to cover 26 a top opening of the container. The lower surface 14 of the base 12 has an annular lip 15 downwardly extending therefrom around the outer perimeter of the base 12. The lip 15 is designed for helping hold the base 12 to the top of the container 1.

The wall 16 may be any shape but, preferably, it is generally rectangular and defines an interior space. The interior spaced is designed for receiving a tool such as a trowel 3 therein. Optionally, the interior space may be filled with a cleaning solution for cleaning a trowel 3 disposed therein. The wall 16 has a top edge 17, a pair of spaced apart ends 18,19 and a pair of spaced apart sides 20,21 extending between the ends 18,19 of the wall 16. The top edge 17 of the wall 16 defines an upper opening into the interior space. Preferably, the interior space is centrally located on the upper surface 13 of the base 12. The upper surface 13 of the base 12 has a plurality of spaced apart elongate ridges 22,23,24 upwardly extending therefrom. The ridges 22,23, 24 are located in the interior space with the lengths each of the ridges 22,23,24 extending between the sides 20,21 of the wall 16. The ridges 22,23,24 are designed for resting the blade of a trowel thereon.

The cover 26 has upper and lower faces 27,28. The lower face 28 rests on the top edge 17 of the wall 16 such that the cover 26 substantially covers the upper opening into the interior space. The lower face 28 of the cover 26 preferably has a lower lip 29 extending around the outer perimeter of the cover 26. The lower lip 29 is designed for helping hold the cover 26 on the wall 16. The cover 26 has a handle portion 30 upwardly extending from the upper face of the cover 26. The handle portion 30 is designed for aiding the lifting of the cover 26. The handle portion 30 is preferably generally rectangular. The handle portion also defines a recess 31 in the lower face of the cover 26. The recess 31 is designed for receiving a handle 4 of a trowel 3 in the interior space when the cover 26 is covering the top opening into the interior space.

Optionally, a handle attachment 32 may also be included. The handle attachment is generally an inverted U-shape and has a main portion 33 and a pair of arms 34,35. Each of the arms 34,35 has a hook portion 36,37 adapted for hooking a handle 2 of a container 1 such as a bucket handle.

In use, the holding lid 10 allows a user to conveniently store trowel on a lid covering a bucket. The interior space may be filled with a cleaning solution 5 to help keep the trowel clean between uses.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination, a cylindrical container having a half hoop handle and a circular top opening; and a lid for holding a trowel in association with the container; said lid comprising:

a planar base being generally circular and having upper and lower surfaces and an outer perimeter;

said lower surface of said base being removably mounted on an upper edge of a container such that said lower surface is held in a position above an interior of the container whereby said planar base covers the top opening of the container, said lower surface of said base having an annular lip being extended therefrom around said outer perimeter of said base, said annular lip coupling said base to the container such that the annular lip is positioned adjacent to an outer surface of the container;

a wall extended from said upper surface of said base, said wall defining an interior space adapted for holding the trowel, said wall being structured such that said interior space is generally rectangular, said wall having a top edge, a pair of spaced apart ends and a pair of spaced apart sides extending between said ends of said wall, said top edge of said wall defining an upper opening into said interior space, said interior space being centrally located on said upper surfacc of said base;

said upper surface of said base having a plurality of elongate ridges extending upwardly therefrom, said ridges being located in said interior space, each of said ridges having a length, said lengths of said ridges being extended between said sides of said wall, said ridges being adapted for supporting a planar blade of the trowel such that a portion of the blade of the trowel is suspended in spaced relationship to the upper surface of the base to facilitate contact between a cleaning solution within the interior space and the trowel blade;

a cover having an outer perimeter and upper and lower faces, said lower face resting on said top edge of said wall such that said cover substantially covers said upper opening into said interior space;

said lower face of said cover having a lower lip extending around said outer perimeter of said cover;

said cover having a handle portion extending from said upper face of said cover, said handle portion being generally rectangular said handle portion defining a recess in said lower face of said cover, said recess being for receiving a handle of a trowel in said interior space when said cover is covering said top opening into said interior space; and a handle attachment being generally an inverted U-shape and having a main portion and a pair of arms, each of said arms having a hook portion hooking the half hoop handle of the container.

* * * * *